United States Patent [19]

Schreder

[11] Patent Number: 4,611,112

[45] Date of Patent: Sep. 9, 1986

[54] ELECTRIC HOTPLATE

[75] Inventor: Felix Schreder, Oberderdingen, Fed. Rep. of Germany

[73] Assignee: EGO Elektro-Geräte Blanc und Fischer, Fed. Rep. of Germany

[21] Appl. No.: 658,429

[22] Filed: Oct. 5, 1984

[30] Foreign Application Priority Data

Oct. 6, 1983 [DE] Fed. Rep. of Germany ..... 3336311

[51] Int. Cl.[4] ..... H05B 3/68

[52] U.S. Cl. ..... 219/455; 219/445; 219/464

[58] Field of Search ..... 219/214, 218, 443, 445, 219/446, 447, 448, 449, 452, 455, 456, 462, 464, 466, 480, 530, 524, 525; 99/375; 338/316

[56] References Cited

U.S. PATENT DOCUMENTS

| | | | |
|---|---|---|---|
| 1,705,702 | 3/1929 | Bacher | 219/445 |
| 1,715,692 | 6/1929 | Bacher | 219/445 |
| 2,276,005 | 3/1942 | Vouvalidas | 219/445 X |
| 2,786,929 | 3/1957 | Michaelis | 219/445 |
| 3,233,079 | 2/1966 | Wunderlin | 219/214 |
| 3,719,507 | 3/1973 | Bardeau | 99/375 |
| 3,739,149 | 6/1973 | Fischer et al. | 219/445 |
| 3,909,592 | 9/1975 | Eide | 219/462 |
| 4,122,330 | 10/1978 | Fischer et al. | 219/449 |
| 4,158,127 | 6/1979 | Husslein | 219/446 |
| 4,313,052 | 1/1982 | Fischer | 219/446 |
| 4,493,979 | 1/1985 | Bredel | 219/446 |

FOREIGN PATENT DOCUMENTS

| | | | |
|---|---|---|---|
| 221201 | 5/1962 | Austria | 219/445 |
| 74105 | 10/1916 | Fed. Rep. of Germany . | |
| 187383 | 11/1936 | Fed. Rep. of Germany . | |
| 202499 | 1/1939 | Fed. Rep. of Germany . | |
| 687647 | 11/1940 | Fed. Rep. of Germany . | |
| 908646 | 4/1954 | Fed. Rep. of Germany . | |
| 1817224 | 8/1960 | Fed. Rep. of Germany . | |
| 8103701 | 6/1981 | Fed. Rep. of Germany . | |
| 3010334 | 9/1981 | Fed. Rep. of Germany . | |
| 798634 | 5/1936 | France . | |
| 906043 | 12/1945 | France | 219/447 |
| 1049727 | 12/1953 | France | 219/445 |
| 413607 | 5/1946 | Italy | 219/445 |
| 419161 | 3/1947 | Italy | 219/445 |

*Primary Examiner*—Clarence L. Albritton
*Assistant Examiner*—Teresa J. Walberg
*Attorney, Agent, or Firm*—Steele, Gould & Fried

[57] ABSTRACT

A cast material hotplate with heating resistors embedded in grooves on the bottom surface has an elongated oval shape and on the bottom surface two independent heating zones, which in each case contain substantially circular heating ring zones. In the intermediate area, the casting is separated by a separating gap and tightly interconnected by an inserted sheet metal strip, which is optionally provided with an expansion bead. The sheet metal strip ensures that the flat cooking surfaces are aligned with respect to one another and the double hotplate is suitable for individual cooking vessels, which can be placed on each of the two sides, and for large joint cooking vessels.

8 Claims, 6 Drawing Figures

Fig. 1
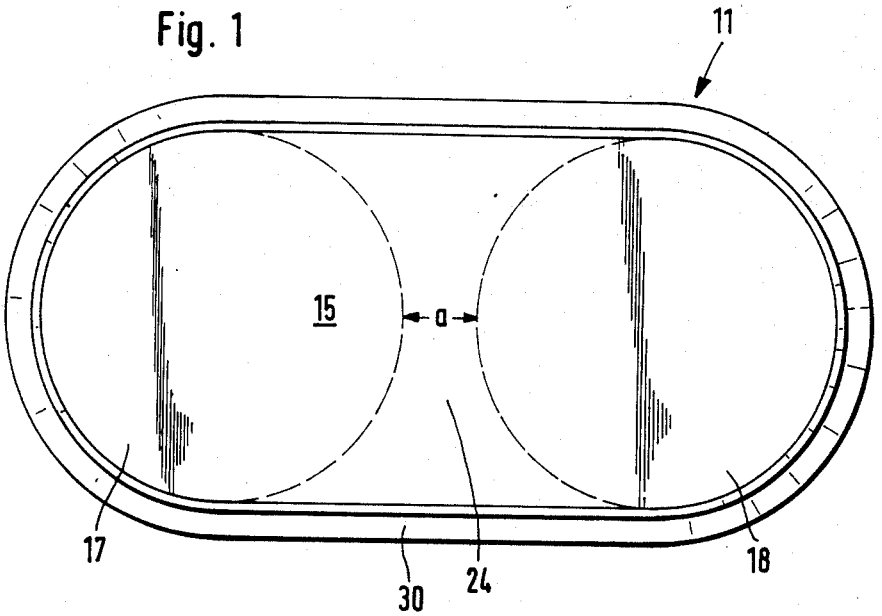
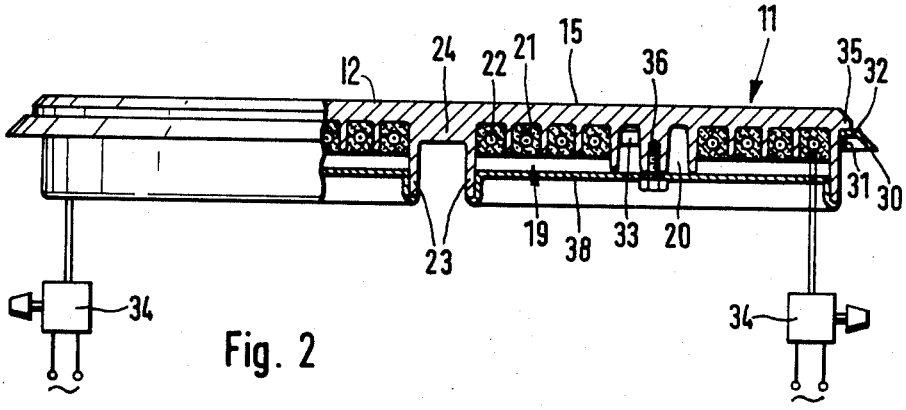
Fig. 2

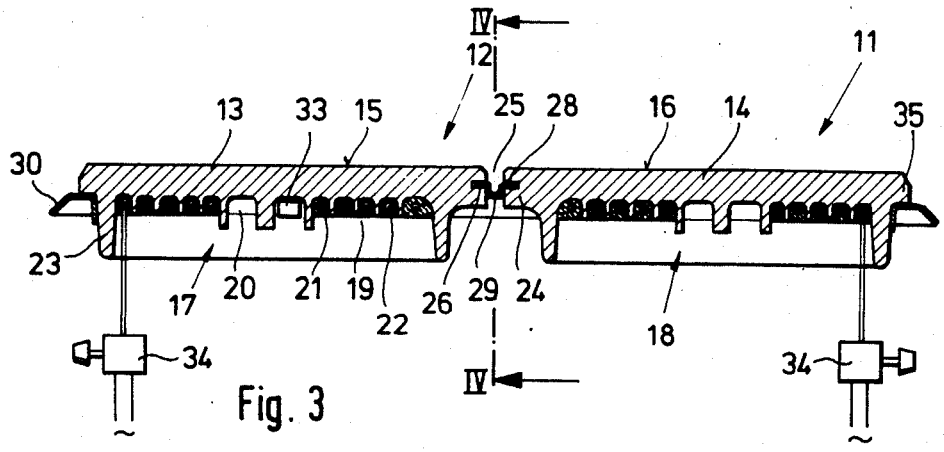
Fig. 3
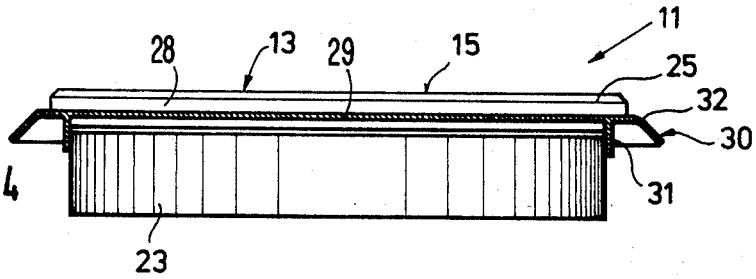
Fig. 4
Fig. 5
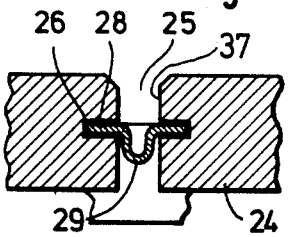
Fig. 6
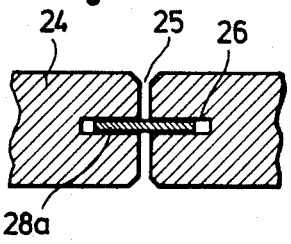

ELECTRIC HOTPLATE

BACKGROUND OF THE INVENTION

Electric hotplates are known from German Utility Model 81 03 701 containing a hotplate body made from cast material and a heating means for the same, the heating means having electrical resistors embedded in grooves on the bottom of the hotplate body, the body having an elongated flat upper surface. In plan view, such hotplates have an oval shape and on their bottom surface have a common heating system with incorporated electrical heating resistors. They are used for heating elongated cooking, baking or roasting vessels.

Circular hotplates are also known, which comprise separate or connected, heated rings. Swiss Pat. No. 187 383 shows the connection of said rings by a sheet metal strip with an expansion seam or bead.

SUMMARY OF THE INVENTION

The object of the present invention is to provide an electric hotplate made from cast material, which has greater flexibility with regards to adaptation to different cooking vessels and tasks, whilst still permitting an adequate life and good efficiency. This object is achieved by a hotplate as above-described, and in which the heating system comprises two juxtaposed, spaced, separately-heatable heating zones, between which there is an unheated intermediate area of the hotplate body.

It has hitherto been assumed that two independently heatable heating zones on a cast material hotplate body would not be economical because the non-uniform thermal stresses compromise and distort the hotplate body and the efficiency is low. Tests carried out with the device of the invention have, however, shown that as a result of the solid intermediate area, the distortion or warping tendency can be kept very low and efficiency, even when only heating one heating zone, is very good. Thus, the hotplate is very variable and can heat one or two small cooking vessels, and is capable of doing so at different temperatures and capacities, or can receive one elongated cooking vessel, which can be very uniformly heated. Thus, there are essentially two circular cooking surfaces which, in each case on one side, are supplemented by an unheated connecting part in the direction of the other heating zone. The outline of the hotplate body, in plan view, is defined by two spaced semicircles and straight lines connecting the same. However, it is also possible to have other shapes, e.g. an oval shape without straight edges and in certain circumstances this leads to the advantage that there is non-positive all-round pressing of the spillage rim surrounding the hotplate.

If the hotplate body also has a separating gap in the intermediate area between the two heating zones, and the two hotplate body parts are interconnected by a connecting means permitting a certain mobility, the efficiency is still further improved. In spite of this, the two cooking surfaces are accurately aligned with respect to one another, so that a cooking vessel standing on both heating zones always has a good thermal contact. The connecting means can maintain this alignment, i.e. permitting as far as possible no vertical displacement in the vicinity of the connecting gap and also preventing reciprocal tilting of the two cooking surfaces.

In order to facilitate operation, an electrical or mechanical coupling could be provided between the regulating or control means of both heating zones. The intermediate area between the two heating zones is preferably made from a relatively thick cast material, so that no distortions of the casting need be feared in this area.

BRIEF DESCRIPTION OF THE DRAWINGS

Further features of the preferred further developments of the invention can be gathered from the description and drawings, and these features together with those of the subclaims can be realized singly or in various combinations in embodiments of the invention. The embodiments of the invention are described hereinafter relative to the drawings, wherein:

FIG. 1 is a plan view of an electric hotplate.

FIG. 2 is a longitudinal section through the hotplate of FIG. 1.

FIG. 3 is a view according to FIG. 2 with a slotted hotplate body.

FIG. 4 is a cross-section along line IV of FIG. 3.

FIGS. 5 and 6 are two details of the separating gap area.

DETAILED DESCRIPTION OF THE PREFERRED EMBODIMENTS

The drawings show an electric hotplate 11 having a hotplate body 12, which is made from cast material and specifically cast iron. The hotplate body is made from a common casting, which has the elongated shape shown in FIGS. 1 and 2 and which in plan view is formed from two arcs of the same size and the straight lines linking the same.

The length roughly corresponds to double the diameter, plus approximately 1 to 3 cm. The hotplate body is constructed in the manner of two juxtaposed circular hotplates with a double concave intermediate area 24, which interconnects the two circular heating zones 17, 18. Zones 17, 18 are identical, but are constructed in mirror-image manner relative to one another and have a common upper flat cooking surface 15. One each of their bottom surfaces heating resistors 22 embedded in an insulating embedding material are located in spiral grooves 21 and each of the resistors occupies a heating ring area 19, which surrounds an unheated central zone 20. Each circular heating ring area 19 is surrounded by a downwardly directed edge 23, which is connected in the upper outer part a projecting flange 35. The intermediate area 24 between the two heating zones is plate-like, and is made from a relatively thick cast material with a thickness of approximately 10 mm. The minimum spacing between edges 23 is 1 to 3 cm (dimension a).

On edge 23 and the edge of the intermediate area 24 is externally pressed by means of its inner section 31, a stainless steel ring or spillage rim 30 passing round the entire hotplate body and which has the cross-section of an inverted V or U and is supported with its top surface 32 on the bottom surface of flange 35.

A downwardly and outwardly sloping outer portion normally engages over an upright edge of a mounting plate and is supported thereon which permits a tight hotplate mounting.

In the vicinity of the unheated central zone 20 of each heating zone is provided a thermal cutout 33, which senses the hotplate temperature and protects each of the hotplate halves independently against excess temperatures. The regulation or control of the hotplate is also brought about by two individually adjustable regulating or control means 34, but it is also possible to have a common means with optimal or random switchover possibilities. The heating ring area 19 of each heating zone 17, 18 is covered by a cover plate 38 resting on edge 23 and which is fixed to a central bolt 36 in central zone 20. Each heating zone has its own connecting lead.

It has been found that the heating zones 17, 18 can be heated simultaneously or independently of one another, without there being any inadmissible distortion or damage to the hotplate body, which is helped by the solid construction of intermediate area 24. Nevertheless, the efficiency on heating only a single zone is surprisingly good.

As is shown in FIGS. 3 and 4, where there are special demands regarding the efficiency and stress sensitivity of the cast material, in the case of one-sided operation the common cast hotplate body according to FIGS. 1 and 2 can be separated into two bodies 13, 14 by a separating gap 25 in intermediate area 24. Into each separating gap side 37 is milled a relatively deep horizontal groove 26, for example together with the separating gap 25 using a milling cutter with a cross-shaped cut configuration. In said groove is placed in each case a connecting means 28 which, as can be gathered from the detail of FIG. 5, comprises a sheet metal strip, e.g. of stainless steel, which is stamped with a downwardly directed expansion bead 29. To ensure that the separating gap 25 does not become too large, in the case of a downwardly directed bead, it could be made much narrower in the upper region, or the bead could be upwardly directed and could largely seal off the separating gap.

FIG. 4 shows that in the case of a slotted hotplate construction, the connecting means 28 is connected to the spillage rim 30 surrounding the hotplate. The spillage rim 30 runs around the hotplate bodies 15, 16 and correspondingly has an elongated, oval shape. The connecting means 28 is fitted to the spillage rim, e.g. by spot or roll welding and runs level with the upper region 32 of the spillage rim, i.e. it forms a web between the two substantially straight portions of said rim. As a result these are held together and pressed against the hotplate bodies 15, 16.

Particularly in the case of its construction as a straight web **28*a* according to FIG. 6**, without an expansion bead, the connecting means could be directly stamped from the spillage rim material and could form a connected unit therewith.

This construction is chosen if it is ensured that it is possible to absorb linear expansion differences at the ends of the hotplate or in the groove 26. It is also possible to use a construction without a groove 26 with an inverted, V-shaped connecting means pressed on to the separating gap sides 37.

The connecting means 28, **28*a* is able to absorb longitudinal deformation, whilst ensuring that the flat cooking surfaces 15, 16 remain aligned relative to one another and undergo no vertical displacement, which could lead to a step between the cooking surfaces 15, 16 and when a large-area cooking vessel, e.g. an elongated baking or roasting vessel is placed thereon, a gap could form between the same and one of the cooking surfaces. They also prevent any crossing or interlinking of the two cooking surfaces 15, 16 as well as any angular movements of the cooking surfaces 15, 16 relative to one another, particularly in the construction according to FIG. 6**.

The width of separating gap 25 should either be sufficiently large to make it possible to keep it clean from above, or should be virtually non-existent to ensure that no dirt collects there. As the temperatures are not so high in this area, it would be possible to interpose a gasket or seal.

What is claimed is:

1. An electic hotplate, comprising:

a hotplate body made from cast material and heating means for the hotplate body, the hotplate body having an upper, substantially flat cooking surface, the heating means comprising two juxtaposed, spaced, separately heatable heating zones for a common substantially-flat cooking surface of the hotplate body, the cooking surface being of an elongated shape, the hotplate body comprising an intermediate area between the heating zones, each heating zone having electrical heating resistors embedded by insulating material in spiral grooves in a bottom surface of the hotplate body and each heating zone having its own control means and an individual thermal cut-out means, and wherein the two heating zones define left and right parts of a similar shape and construction, the intermediate area being of relatively thick cast material in comparison to adjacent regions of the hotplate body.

2. An electric hotplate according to claim 1, wherein each heating zone is circular and is surrounded by an all-round, vertical edge.

3. An electric hotplate according to claim 1, wherein the intermediate area between the heating zones is made from cast material, which is between 7 and 12 mm thick.

4. An electric hotplate according to claim 1, wherein the distance between the heating zones is between 1 and 3 cm.

5. An electric hotplate according to claim 1, wherein the distance between the heating zones is between 1 and 3 cm.

6. An electric hotplate, comprising:

a hotplate body made from cast material and heating means for the hotplate body, the hotplate body having an upper, substantially flat cooking surface, the heating means comprising two juxtaposed, spaced, separately heatable heating zones for a common substantially-flat cooking surface of the hotplate body, the cooking surface being of an elongated shape, the hotplate body comprising an intermediate area between the heating zones, each heating zone having electrical heating resistors embedded by insulating material in spiral grooves in a bottom surface of the hotplate body and each heating zone having its own control means and an individual thermal cut-out means, and wherein, in plan view, the hotplate body defines an outline of left and right semicircular edges and two straight line edges connecting the semicircular edges.

7. An electric hotplate according to claim 6, wherein each heating zone is circular and is surrounded by an all-round, vertical edge.

8. An electric hotplate according to claim 6, wherein the intermediate area between the heating zones is made from cast material, which is between 7 and 12 mm thick.

* * * * *